US008087527B2

(12) United States Patent
Johnson

(10) Patent No.: US 8,087,527 B2
(45) Date of Patent: Jan. 3, 2012

(54) INTERCONNECTING CONTAINER SYSTEM FOR FOOD OR OTHER PRODUCT

(75) Inventor: Andrew Herman Johnson, Acworth, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 535 days.

(21) Appl. No.: 12/199,290

(22) Filed: Aug. 27, 2008

(65) Prior Publication Data

US 2009/0057306 A1 Mar. 5, 2009

Related U.S. Application Data

(60) Provisional application No. 60/968,727, filed on Aug. 29, 2007.

(51) Int. Cl.
*B65D 21/028* (2006.01)
*B65D 21/024* (2006.01)

(52) U.S. Cl. ..... 220/23.4; 206/504; 220/23.6

(58) Field of Classification Search ..... 220/23.4, 220/23.6; 206/504
See application file for complete search history.

(56) References Cited

U.S. PATENT DOCUMENTS

| | | | | |
|---|---|---|---|---|
| 2,575,294 | A * | 11/1951 | Putorak | 220/23.4 |
| 2,614,399 | A | 10/1952 | Roethel | |
| 2,944,694 | A | 7/1960 | Kinsey | |
| 3,005,282 | A * | 10/1961 | Christiansen | 446/128 |
| 3,498,494 | A | 3/1970 | Voorhees, Jr. | |
| 3,595,425 | A * | 7/1971 | Eicholtz et al. | 220/556 |
| 3,616,943 | A * | 11/1971 | Brink | 206/508 |
| 3,938,688 | A | 2/1976 | Ryan | |
| 4,003,491 | A * | 1/1977 | Wells et al. | 220/23.4 |
| D262,839 | S | 2/1982 | Daenen et al. | |
| 4,556,393 | A | 12/1985 | Bolli | |
| 4,744,780 | A | 5/1988 | Volpe | |
| 4,746,300 | A | 5/1988 | Thevenin | |
| 4,860,896 | A * | 8/1989 | Snider | 206/427 |
| 4,966,298 | A * | 10/1990 | Von Holdt | 220/23.4 |
| 4,982,858 | A * | 1/1991 | von Holdt | 220/23.4 |
| 5,027,972 | A | 7/1991 | Bartholomew | |
| 5,035,324 | A * | 7/1991 | Bertrand | 206/457 |
| 5,295,475 | A | 3/1994 | Kaneko | |
| 5,344,024 | A | 9/1994 | Cohu | |
| 5,366,069 | A | 11/1994 | Seidner | |
| 5,433,314 | A | 7/1995 | Lin | |
| 5,638,974 | A * | 6/1997 | Mann | 220/23.4 |
| 5,676,251 | A * | 10/1997 | Credle, Jr. | 206/501 |

(Continued)

FOREIGN PATENT DOCUMENTS

DE 19 07 662 A1 9/1970

(Continued)

OTHER PUBLICATIONS

International Search Report and Written Opinion—PCT/US2008/074412.

(Continued)

*Primary Examiner* — Anthony Stashick
*Assistant Examiner* — Niki Eloshway
(74) *Attorney, Agent, or Firm* — Womble Carlyle Sandridge & Rice, LLP

(57) ABSTRACT

A container system for containing a product. The container system includes a primary container containing a primary product and at least one secondary container containing a secondary product. The secondary container is releasably connected to the primary container.

17 Claims, 4 Drawing Sheets

U.S. PATENT DOCUMENTS

| | | | | |
|---|---|---|---|---|
| 5,699,913 | A * | 12/1997 | Richardson | 206/470 |
| 5,823,391 | A * | 10/1998 | Klauke et al. | 222/94 |
| 6,173,839 | B1 | 1/2001 | Dieter et al. | |
| 6,412,637 | B1 | 7/2002 | Saunders et al. | |
| 6,938,790 | B2 * | 9/2005 | Hughes | 220/23.4 |
| 7,326,428 | B2 | 2/2008 | Weir | |
| 7,386,896 | B2 * | 6/2008 | Spicer | 4/559 |
| 2003/0141300 | A1 * | 7/2003 | French | 220/23.4 |
| 2006/0091030 | A1 * | 5/2006 | Tawanapoor | 206/320 |

FOREIGN PATENT DOCUMENTS

| | | | |
|---|---|---|---|
| EP | 1 319 604 | A2 | 6/2003 |
| EP | 1 700 788 | A1 | 9/2006 |
| WO | WO 98/21995 | | 5/1998 |
| WO | WO 2006/105180 | A1 | 10/2006 |

OTHER PUBLICATIONS

Supplementary European Search Report, EP Application No. 08828962, mailed Aug. 19, 2010.

* cited by examiner

INTERCONNECTING CONTAINER SYSTEM FOR FOOD OR OTHER PRODUCT

CROSS REFERENCE TO RELATED APPLICATIONS

This application claims the benefit of U.S. Provisional Application No. 60/968,727, entitled CONTAINER SYSTEM FOR FOOD PRODUCT, filed Aug. 29, 2007, which application is incorporated herein by reference in its entirety.

BACKGROUND OF THE DISCLOSURE

The present disclosure generally relates to containers and container systems for holding and dispensing food products.

SUMMARY OF THE DISCLOSURE

In general, one aspect of the disclosure is directed to a container system for containing a food product. The container system comprises at least one primary container and at least one secondary container. The at least one secondary container is for being releasably attached to the primary container. The container system could contain other non-food products (e.g., toy parts, bolts, nuts, other fasteners, or any other product where multiple components are packaged separately in the primary and secondary containers).

In another aspect, the disclosure is generally directed to a container system for containing a product. The container system comprises a primary container for containing a primary product, a secondary container for containing a secondary product, and a releasable connector releasably connecting the primary container and the secondary container. The releasable connector comprising at least one first interlocking connector on one of the primary container and the secondary container, and at least two second interlocking connectors on the other of the primary container and the secondary container.

In another aspect, the disclosure is generally directed to a container for use in a container system having a primary container for holding a primary product and a secondary container for holding a secondary product. The container comprises a bottom wall. At least one side wall extends upward from the bottom wall and has a top edge. A flange extends laterally outward from the top wall. A connector comprises an injection-molded feature connected to the flange. The injection-molded feature has at least one interlocking connecting element.

In another aspect, the disclosure is generally directed to a method of selecting a combination of products to be held in a container system. The method comprises providing a primary container having a primary product therein, and providing a plurality of secondary containers respectively having secondary products therein. The method further comprises selecting at least one secondary product to be packaged with the primary product, and releasably attaching the selected at least one secondary container to the primary container.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure is generally directed to a container system for containing food products or other non-food products. The container system may include various containers or trays similar to the containers, trays, constructs, etc. shown and described in U.S. patent application Ser. No. 11/715,718 filed Mar. 8, 2007, Ser. No. 11/578,357 filed Oct. 8, 2003, and Ser. No. 11/787,769 filed Mar. 18, 2007. The entire text and drawings of U.S. patent application Ser. Nos. 11/715,718, 11/578,357, and 11/787,769 are hereby incorporated by reference herein for all purposes. Also, the container system may include suitable materials, and/or features for heating food products contained therein in an oven (e.g., microwave oven) without departing from the disclosure. In addition, the container system can include various containers or trays for holding non-food items, such as fasteners (e.g., nuts, bolts, washers, etc.), toys, art supplies, or other non-food items.

Figure 1:
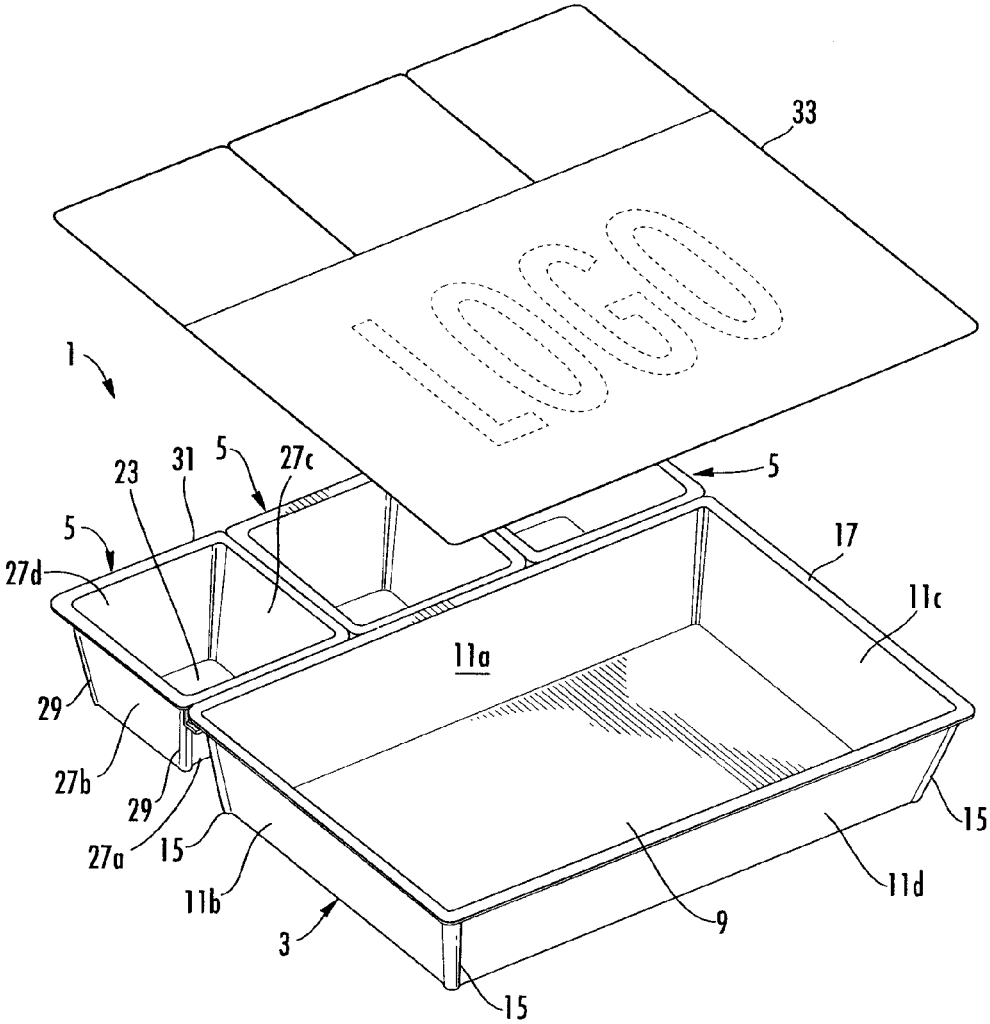
FIG. 1 is a perspective view of a container system of a first embodiment of the present disclosure.

FIG. 1 is a perspective of a container system 1 of one embodiment of the present disclosure. The container system 1 comprises a primary container 3 and three secondary containers 5 attached to the primary container. The container system 1 may contain a primary food product (not shown) in the primary container 3 and a secondary food product (not shown), such as a complementary food product to be consumed with the primary food product, in the secondary containers 5. In exemplary embodiments, the primary food product in the primary container 3 may include, e.g., tortilla chips/nachos, burritos, chicken fingers, etc., and the secondary food product in each secondary container 5 may comprise a condiment (e.g., salsa, cheese, sour cream, ketchup, mustard, etc.) or other complimentary food products that may be selected to enhance the flavor of the primary food product. Further, the container system 1 could be used to package a complete meal wherein the main course of the meal is contained in the primary container 3 and the side items are contained in the secondary containers 5. As discussed below, a releasable connection between the secondary containers 5 and the primary container 3 allows a consumer or food service provider to select the desired combination of secondary food products to be package with the primary food product.

As shown in FIG. 1, the primary container 3 comprises a bottom wall 9 and four side walls 11*a*-11*d*. The primary container 3 is large enough to hold a primary food product (not shown) to be packaged in the container system 1. In the illustrated embodiment, the primary container 3 is a tray that is similar to the tray shown and described in U.S. patent application Ser. No. 11/715,718. In the illustrated embodiment, the tray 3 includes a polymeric frame having corner elements 15 between adjacent side walls that extend downwardly from a substantially rigid polymeric flange 17 extending around the top of the side walls. In accordance with the first embodiment, the corner elements 15 advantageously hermitically seal the corners of the tray and cooperate with the flange 17 to provide rigidity to the tray. In alternate embodiments, the corner elements 15 could be separate from the flange 17, the tray 3 could include press-formed corners without polymeric corner elements, or the flange 17 could be integral with the side walls of the tray.

The secondary containers 5 are each of similar construction as the primary container described above. For example, each secondary container has a bottom wall 23, four side walls 27*a*-27*d*, corner elements 29, and a top flange 31. In the illustrated embodiment, the top flange 31 and corner elements 29 are a polymeric material and are a one-piece structure similar to the corner elements 15 and flange 17 of the primary container 3. The secondary containers 5 are sized for holding complementary food products, such as condiments, cheese, dipping sauces, side dishes, etc., and are typically smaller than the primary containers 3. However, the container system 1 of the present disclosure may comprise secondary containers 5 that are of equal or larger size than the primary container 3 without departing from the disclosure. Further, the primary container 3 and secondary containers 5 could be other than four-sided trays (e.g., circular, triangular, etc.) without departing from the disclosure.

As shown in FIG. 1, the container system 1 includes a lid 33 that covers the open tops of the primary and secondary containers 3, 5. The lid 33 may be attached to the primary and/or secondary containers 3, 5 by conventional methods (e.g., adhesive, interlocking grooves, overwrap of cellophane or other material, or other conventional methods). Further, the lid could only partially cover one or more of the containers 3, 5 or could be omitted without departing from the disclosure. Each of the containers 3, 5 only includes a separate lid of its own.

Figure 2:
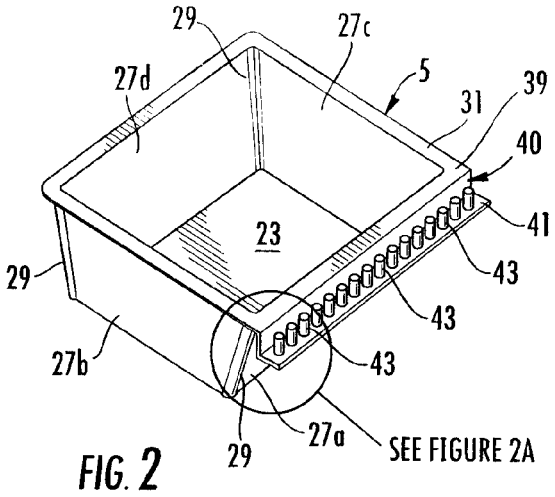
FIG. 2 is a top perspective of a secondary container of the container system of the first embodiment.
Figure 2A:
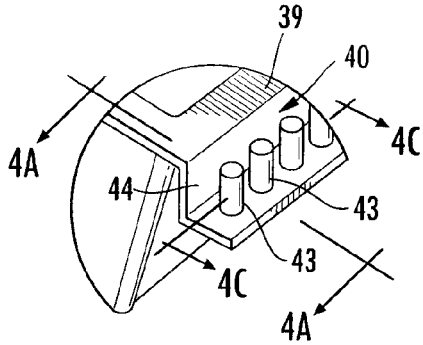
FIG. 2A is an enlarged portion of FIG. 2.

FIGS. 2 and 2A show a detail perspective of a secondary container 5 detached from the primary container 5. As shown in FIG. 2, the secondary container 5 has a front flange portion 39 extending from the front side wall 27*a* of the container. The secondary container 5 includes a first connector portion 40 that is injection-molded onto the underside of the flange portion 39 of the container. The first connector portion 40 can be formed in the same injection molding process as the flange 31 and corner elements 29 and may be the same or different material as the flange and corner elements. The first connector portion 40 is made from a suitable thermoplastic material or may include other suitable materials. The first connector portion 40 has a flange portion 42 beneath the flange portion 39 of the container 5, a bottom shelf 41 spaced below the flange portion, and a rear wall 44 connecting the flange portion and the bottom shelf. A plurality of first projections 43 extend upward from a surface of the bottom shelf 41. In the illustrated embodiment, the first projections 43 are cylindrical projections arranged in a single row across the bottom shelf 41. However, the first projections 43 may be otherwise shaped, arranged, and located on the secondary container 5 without departing from the disclosure. Further, the first projections 43 can be formed from the same material during the injection molding process that forms the bottom shelf 41, or the projections can be made from a different material than the bottom shelf.

Figure 3:
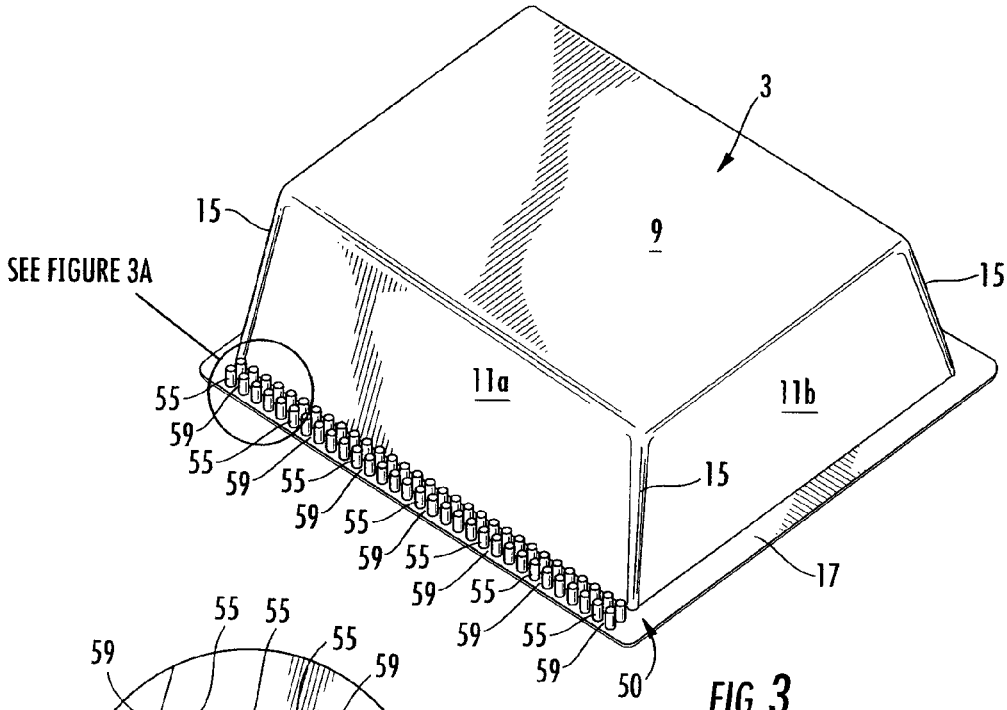
FIG. 3 is a bottom perspective of a primary container of the container system of the first embodiment.
Figure 3A:
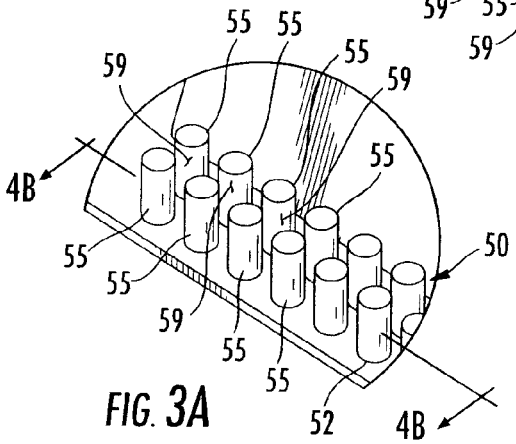
FIG. 3A is an enlarged portion of FIG. 3.
Figure 4A:
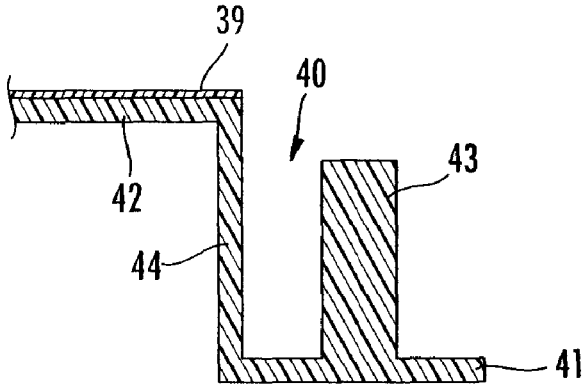
FIG. 4A is a cross-section in the plane including line 4A-4A of FIG. 2A.
Figure 4B:
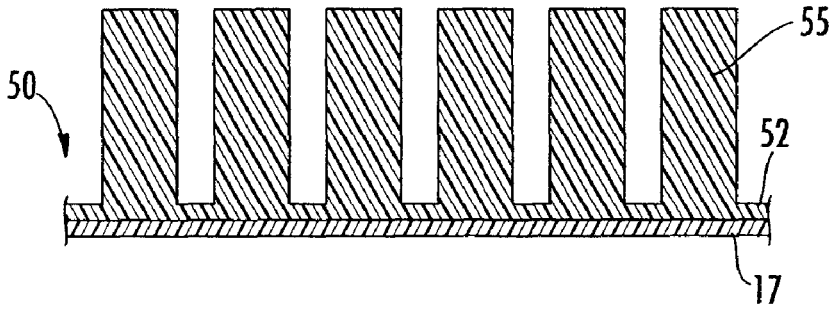
FIG. 4B is a cross-section in the plane including line 4B-4B of FIG. 3A.
Figure 4C:
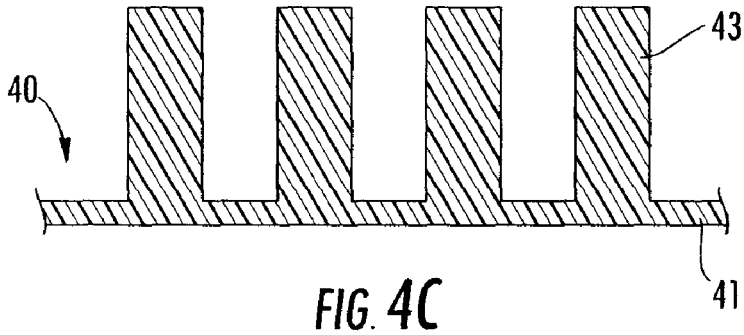
FIG. 4C is a cross-section in the plane including line 4C-4C of FIG. 2A.

FIGS. 3 and 3A show a bottom perspective of the primary container 3. A front portion 51 of the flange 17 of the primary container 3 extends laterally outward from a front side wall 11*a* of the container. The primary container 3 includes a second connector portion 50 injection-molded on the underside of the flange 17. The second connector portion 50 can be formed in the same injection molding process as the flange 17 and corner elements 15 and may be the same or different material as the flange and corner elements. In the illustrated embodiment, the second connector portion 50 includes a flange portion 52 on the undersurface of the flange 17 and a plurality of second projections 55 projecting downward from the flange portion. The second connector portion 50 is made from a suitable thermoplastic material or may include other suitable materials. In the illustrated embodiment the second projections 55 on the primary container 3 are cylindrical projections arranged in two spaced-apart rows extending lengthwise of the container.

In one embodiment, the second projections 55 on the primary container 3 and the first projections 43 on the secondary container 5 have respective external surfaces that are sized and shaped for a close friction fit along their axial lengths when the first and second projections are interdigitated relative to each other. The interdigitated first and second projections 43, 55 form a releasable, interlocking connector that allows removable attachment of the secondary container 5 to the primary container 3.

In the illustrated embodiment, each group of four adjacent projections 55 of the second connector portion 50 are spaced apart to form receiving spaces 59 for receiving a respective projection 43 on the secondary container 5. For example, in the illustrated embodiment, each grouping of four projections 55 of the second connector portion 50 forms one receiving space 59 for respectively receiving one of the projections 43 on the secondary container 5. When the first projection 43 and second projections 55 are interdigitated relative to one another, an axial contact area between respective external axial surfaces of the first and second projections establishes the releasable connection between the primary container and the secondary container.

In the illustrated embodiment, when the projections 43 of the secondary container 5 are aligned with and pressed upward into respective receiving spaces 59 between the projections 43 of the primary container 3, a releasable interlocking engagement results such that the secondary container is releasably connected to the primary container. In the illustrated embodiment, the projections 43, 55 of the first and second connector portions 40, 50 are interdigitated and interlockingly engage in a manner similar to interlocking LEGO brand building blocks. The projections 43, 55 of the first and second connectors 40, 50 could be otherwise shaped and arranged without departing from the disclosure.

Figure 5A:
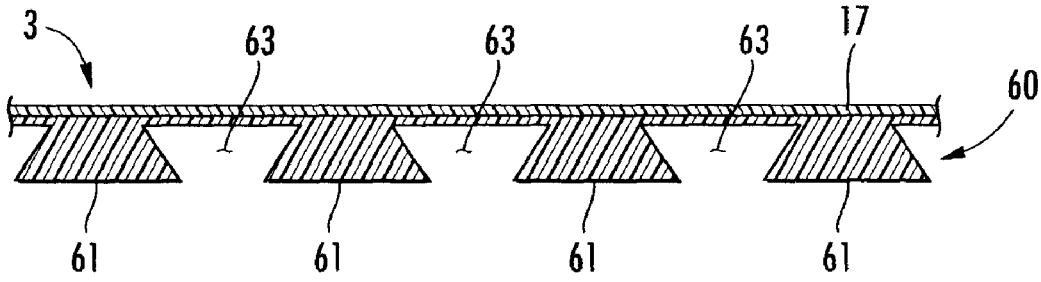
FIG. 5A is a partial cross-section of a primary container of a second embodiment of the disclosure.
Figure 5B:
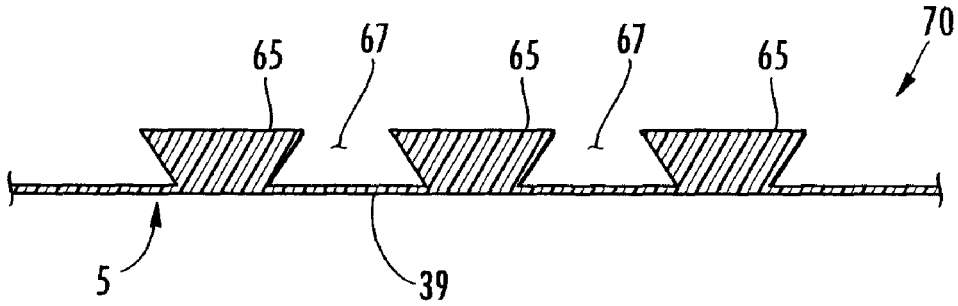
FIG. 5B is a partial cross-section of a secondary container of the second embodiment.

The primary container and secondary containers 3, 5 may be releasably attached through other connecting methods. For example, FIGS. 5A and 5B show one alternative embodiment of the first connector 70 and the second connector 60. In this embodiment, the second projections 61 are shaped to form spaces 63 therebetween. The spaces 63 are sized for receiving a correspondingly shaped first projection 65 of the first connector 70. The first and second connectors 60, 70 can be interdigitated by vertically aligning the first projections 65 on the first connector 70 on the secondary container 5 with the spaces 63 between the projections 61 on the second connector 60 on the primary container 3 and inserting the projections on the secondary container into the spaces by laterally moving the secondary container toward the primary container. Also, the first projections 65 on the first connector 70 form spaces 67 that receive and retain the second projections 61 on the primary container 3. The tight fit between the first and second projections 65, 61 creates a releasable interlocking connection between the first connector 70 on the secondary container 5 and the second connector 60 on the primary container 3 when the projections 65, 61 are interdigitated relative to each other.

In the embodiment of FIGS. 5A and 5B, the first and second projection 65, 61 are trapezoidal in cross-sectional shape. Also, the corresponding spaces 63, 67 between each projection 65, 61 are trapezoidal in shape. The projections 61, 65 and/or spaces 63, 67 could be otherwise shaped, arranged, and configured without departing from the disclosure. The embodiment of FIGS. 5A and 5B is like the embodiment shown in the other figures, except for variations noted and variations that will be apparent to one of ordinary skill in the art.

In use, the container system 1 of the present disclosure allows a user to mix and match the desired condiments or complimentary food product contained in the secondary containers 5 with the type of food product contained in the primary container 3. In one embodiment, a user will select the desired food product and the desired condiments, and then connect the corresponding secondary container(s) 5 containing the selected condiments to the primary container 3 containing the selected food product. In a typical retail setting (e.g., grocery store), each primary container 3 and secondary container 5 would have separate price code associated therewith and would be paid for separately by the consumer. Alternatively, a grocer, manufacturer, or other food supply merchant may preassemble popular combinations of primary containers 3 and secondary containers 5 to provide an inventory of one or more popular combinations of primary food products and complementary food products. The preassembly of the primary container and secondary containers would save the customer time in assembling the container system 1 to the desired configuration. Further, the initially selected secondary container(s) 5 can be removed from the primary container 3 and replaced with an alternative secondary container having an alternative secondary food product.

The containers 3, 5 of the present disclosure may comprise paperboard and polymeric materials such as the materials described in U.S. patent application Ser. Nos. 11/715,718, 11/578,357, and 11/787,769, or any other suitable materials. Furthermore, the containers may be formed from any of the methods and tools described in U.S. patent application Ser. Nos. 11/715,718, 11/578,357, and 11/787,769, or any other suitable method or tool. Also, U.S. Provisional Application Ser. No. 61/017,850 filed Dec. 31, 2007, illustrates a forming tool that can be used to form either or both of the containers 3, 5 of the present disclosure. The entire content of U.S. Provisional Patent Application Ser. No. 61/017,850 is incorporated by reference herein for all purposes. The connecting features, (e.g., first connector portion 40, second connector portion 50) of the primary container 3 and secondary container 5 can be created by injection molding the features on the container. Further, the connecting features can be manufactured by creating interlocking features in a paperboard flange of the container(s) or, the interlocking features can be created by other suitable methods using other suitable materials. The connecting features (e.g., first connector portion 40, second connector portion 50) can be internally formed with the injection-molded flanges 17, 31, or the connecting features can be separately formed and attached to the flanges. The interconnecting features and the flanges 17, 31 could comprise an injection molded material, the flanges 17, 31 could comprise paperboard and the interconnecting features could comprise injection molded material, both the flanges and the interconnecting features could comprise paperboard, or the flanges and/or the interconnecting features could comprise other materials.

In accordance with alternative embodiments of the disclosure, the secondary containers 5 can be releasably attached to the primary containers 3 via other methods and mechanisms for forming a releasable connection between two components. For example, the secondary containers 5 could be releasably connected to the primary containers 3 with removable adhesives, resealable tape, pressure sensitive adhesive, or any other suitable material or mechanism for forming a releasable connection.

In one example, the containers 3, 5 are attached to one another after they respectively contain food. In one example a plurality of the containers 3, 5 are filled with food and then respectively covered with lids, and thereafter the containers are attached to one another using the attachment features of this disclosure. Thereafter, a group of the containers 3, 5 that are connected together may be together put into an oven (e.g., a microwave oven) for heating purposes, or the containers may be separated from one another before heating, such as if there are different heating requirements for the separated containers. The group of containers 3, 5 may remain connected together while the lids of the containers may be removed in a serial fashion (e.g., one after the other). The containers 3, 5 that are attached to one another using the attachment features of this disclosure may have originated from different locations, may have different types of food therein, may have different types of microwave interactive materials (e.g., susceptors) attached thereto, and may vary in other ways.

The foregoing description illustrates and describes various embodiments of the present disclosure. As various changes could be made in the above construction, it is intended that all matter contained in the above description or shown in the accompanying drawings shall be interpreted as illustrative and not in a limiting sense. Furthermore, the present disclosure covers various modifications, combinations, alterations, etc., of the above-described embodiments. Additionally, the disclosure shows and describes only selected embodiments, but various other combinations, modifications, environments, changes, and/or modifications are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments without departing from the scope of the disclosure. It will be understood by those skilled in the art that while the present disclosure has been discussed above with reference to exemplary embodiments, various additions, modifications and changes can be made thereto without departing from the spirit and scope of the claims.

What is claimed is:

1. A container system for containing a product, the container system comprising:

a primary container for containing a primary product;

a secondary container for containing a secondary product; and a releasable connector releasably connecting the primary container and the secondary container, the releasable connector comprising at least one first interlocking connector on one of the primary container and the secondary container, and at least four second interlocking connectors on the other of the primary container and the secondary container, the at least one first interlocking connector comprises a first projection and the at least four second interlocking connectors comprise second projections, the first projection is connected to the underside of a flange of the secondary container and comprises a first solid cylindrical body having a first axial length and the second projections each comprise a second solid cylindrical body having a second axial length, the second projections comprise four second projections spaced apart to form a receiving space for receiving the first projection, the first projection and second projections have respective external surfaces that are sized and shaped for a close friction fit along their axial lengths, and the first cylindrical body being sized for placement in the receiving space and for being in contact with the second cylindrical body of the four second projections when the first projection and second projections are interdigitated relative to one another thereby to create an axial contact area between the first projection and the second projections to establish a releasable connection between the primary container and the secondary container.

2. The container system of claim 1 wherein the primary product is a primary food product and the secondary product is a secondary food product.

3. The container system of claim 2 in combination with a primary food product and a secondary food product.

4. The container system of claim 1 wherein the at least one first interlocking connector is on the secondary container and the at least two second interlocking connectors are on the primary container.

5. The container system of claim 1 wherein the releasable connector comprises a first connector portion on the secondary container, the first connector portion comprises a shelf spaced below the flange, the first projection projects upwardly from a surface of the shelf.

6. The container system of claim 5 wherein the first connector comprises a flange portion attached to the flange of the secondary container, and a rear wall extending between the flange portion and the shelf.

7. The container system of claim 6 wherein the releasable connector comprises a second connector portion on the primary container comprising a flange portion in contact with a flange of the primary container, the second projections extend downward from the flange portion.

8. The container system of claim 7 wherein the flange of the primary container and the flange of the secondary container each comprise an injection-molded material, and the first connector portion is integrally formed with the flange on the secondary container and the second connector portion is integrally formed with the flange on the primary container.

9. The container system of claim 7 wherein the second connector portion comprises the four second projections.

10. A container for use in a container system having a primary container for holding a primary product and a secondary container for holding a secondary product, the container comprising:

a bottom wall;

at least on side wall extending upward from the bottom wall and having a top edge;

a flange extending laterally outward from the top edge;

a connector comprising an injection-molded feature having a flange portion connected to an underside of the flange, a shelf portion spaced below the flange, and a rear wall connecting the flange portion and the shelf portion, the injection-molded feature having at least one interlocking connecting element projecting upwardly from the shelf portion, the at least one interlocking connecting element of the connector comprises two rows of a plurality of projections, wherein each adjacent grouping of four projections forms a receiving space.

11. The container of claim 10 wherein the interlocking connecting element comprises a projection having a cylindrical body.

12. The container of claim 10 wherein the interlocking connecting element comprises a projection having a trapezoidal cross-sectional shape.

13. The container of claim 10 wherein the connector is connected to an underside of the flange.

14. The container of claim 10 wherein the container is a primary container for holding a primary food product in the container system.

15. The container of claim 10 wherein the container is a secondary container for holding a secondary food product in the container system.

16. The container of claim 10 wherein the flange is formed from an injection-molded material and the connector comprises an injection-molded material and is integrally formed with the flange.

17. The container of claim 10 wherein the flange comprises paperboard and the connector comprises an injection-molded material attached to the flange.

* * * * *